US005992136A

United States Patent [19]

Langen

[11] Patent Number: 5,992,136

[45] Date of Patent: Nov. 30, 1999

[54] METHOD FOR EXCHANGING SLIVER CANS AT A SPINNING MACHINE

[76] Inventor: Manfred Langen, Schulstrasse 58, D-441065 Mönchengladbach, Germany

[21] Appl. No.: 08/909,692

[22] Filed: Aug. 12, 1997

[30] Foreign Application Priority Data

Aug. 16, 1996 [DE] Germany ..... 19632934

[51] Int. Cl.[6] ..... D01H 9/10

[52] U.S. Cl. ..... 57/281; 19/159 A; 57/90

[58] Field of Search ..... 19/159 A; 57/281, 57/90

[56] References Cited

U.S. PATENT DOCUMENTS

| | | | |
|---|---|---|---|
| 5,276,947 | 1/1994 | Frischi et al. | 19/159 A |
| 5,471,711 | 12/1995 | Koyacs et al. | 19/159 A |
| 5,500,986 | 3/1996 | Leifeld et al. | 57/281 |
| 5,511,372 | 4/1996 | Leidgens | 57/90 |
| 5,535,581 | 7/1996 | Tahara et al. | 57/291 |
| 5,632,138 | 5/1997 | Liedgens | 57/90 |
| 5,729,868 | 3/1998 | Leidgens et al. | 19/159 A |

*Primary Examiner*—William Stryjewski
*Attorney, Agent, or Firm*—Kennedy Covington Lobdell & Hickman, LLP

[57] ABSTRACT

A method for the exchange of full for empty rectangular spinning cans for a spinning machine having a plurality of spinning stations is described. With the method a conveying track is provided respectively between two rows of n spinning stations for the feeding of full sliver cans and the removal of empty sliver cans. In order to achieve that the conveying track can be simultaneously used as a holding area of a can circulation, as many as possible initially full sliver cans are stored on the conveying track and are exchanged in steps for empty cans at the spinning stations in the course of a back and forth movement in the conveying direction. In the course of the can exchange the exchange phase can move with a back and forth movement in the conveying direction of a can block present on the conveying track in one case along the closely packed can block from one can to the other or, in another case, when the cans are spaced apart beforehand on the conveying track, it can take place in the gap distance in one back and forth movement of the can block.

2 Claims, 1 Drawing Sheet

METHOD FOR EXCHANGING SLIVER CANS AT A SPINNING MACHINE

FIELD OF THE INVENTION

The invention relates to method for the exchange of full rectangular sliver cans for empty ones at a spinning station of a spinning machine, such as an open end spinning machine, wherein a conveying track for bringing in full sliver cans and for taking away empty sliver cans is disposed respectively between two rows of n spinning stations.

BACKGROUND OF THE INVENTION

In what follows, the term empty sliver cans or empty cans will be used, which will include sliver cans that have not yet been completely emptied, but should be taken out of the working position of a spinning station or spindle. A full sliver can is also called a full can. A spinning station, where there is no sliver can for working during the can exchange, is also called an empty station. In contrast to the conventional cylindrical cans, a rectangular sliver can or rectangular can has an essentially rectangular layout or cross section.

In general, the fiber strands to be processed in spinning machines are first drawn and wound on drawing frames or flyers. For example, with the open end method the fiber strands are drawn in three drawing machines placed one after the other and are then filled into empty sliver cans. Today, cans are generally rectangular. The full cans are then transported to the spinning machine. There, the sliver cans are placed into the working position at respective spinning stations. The sliver cans can be exchanged individually, in sections or in entire blocks. In all systems the exchange of a full can for an empty can at a spinning machine can be performed manually or automatically by means of an appropriate device. In a spinning machine, a group of spindles or spinning stations between respectively two supports, which are part of the machine frame, is called a section. The distance between two spinning stations at a section boundary can be greater by a few centimeters than that between two spinning stations within a section.

In the actual open end operation which is common at this time, the filled cans are exchanged for the empty cans coming from the spinning department at the drawing machines, which are positioned ahead of the spinning machine, and are taken manually or by means of automatically controlled transport vehicles to the spinning machine and are there manually or automatically exchanged for empty cans. The empty cans are again returned to the drawing machine, etc.

One problem in many spinning mills lies in that a stacking space for storing or holding the sliver cans in their circuit between the drawing and spinning departments is lacking. Although many cans can stand on the conveying track between each two rows of spinning stations of the spinning machine, if the conveying track is filled with full or empty sliver cans, it is customarily difficult or even impossible to perform a can change (empty cans for full cans) at the spinning station.

OBJECT AND SUMMARY OF THE INVENTION

The object of the present invention is to provide a method for the exchange of empty cans for full cans at the respective spinning stations, which permits the simultaneous use of the conveying track as a can storage or holding area during the can exchange.

Basically, the method of the present invention involves a forward and backward movement, a reciprocating movement by respectively one step, namely essentially by the width of one can, of the cans on a conveying track. After every back-and-forth movement, an empty can is brought from a spinning station onto the conveying track and a full can from the conveying track to a free can location of a spinning station in alternation. Such a reciprocating back and forth movement of the cans on the conveying track with the replacement of an empty can at a spinning station by a full can from the conveying track constitutes a so-called exchange phase.

If in connection with the above a "can width" is mentioned, in case of a rectangular can this means the length of the smaller rectangular side.

The method in accordance with the invention permits the use of the conveying track for an entire block of sliver cans at a can holding area for full and/or empty cans. From the number of held full sliver cans, individual cans can be exchanged for empty cans at individual spinning stations. The full cans are possibly brought to the one longitudinal end, the feed end, of the conveying track, and are removed on its other longitudinal end, the removal end. In this way the conveying track becomes a part of the can circulation.

At least two exchange sequences are possible in accordance with the present invention in exchanging an empty can for a full can at the respective spinning stations. In one case, in the course of the reciprocating movement from one can to the next and from one spinning station to the next the exchange phase moves sequentially along the conveying track or along the spinning machine from one end to the other of a fully packed can block. In the other case, the cans in the can block of the conveying track are spaced apart already at the start of the can exchange with a gap between adjacent cans, so that the exchange phase can take place along the can block in a single reciprocating movement at the same time, but only at every other spinning station. The gap is intended to provide space for one can, it therefore corresponds to a can width; this will also be called a can gap in what follows.

In the two described cases the conveying track is used as a can storage or holding area simultaneously with the operation of the method and during the can exchange. It is possible to store one can block of full cans on the conveying track. When the cans have been exchanged, the block of empty cans which was created can also be stored on the conveying track until it is needed in the can circulation, for example at a drawing machine. If there are n spinning stations on each side of the conveying track, and m is a small whole number larger than or equal to one but smaller than n, the block can contain n/m sliver cans. If, for example, m=2, the can block occupies half the length of the row of spinning stations or of the conveying track when the cans in contact against each other without gaps.

The following procedure for the can exchange is followed in connection with the two cases mentioned:

A. Block Exchange with the Cans Placed Close Together in the Block on the Conveying Track In this case the storage capacity when the can exchange is ready to be made is maximal. With m=1, the can block present on the conveying track can take up the entire conveying track. However, for easy handling only, preferably one-half of the conveying track is filled with cans, so that m=2 applies.

Preferably the can exchange starts with the first can which is closest to the removal side of the conveying track. During the can exchange the block is retracted in a first step in a first exchange phase by one can width (measured in the conveying direction) towards the feed end. Because of this a can gap is created on the conveying track in front of the empty can of the first spinning station located there. The empty can is brought into this gap by a displacement transversely to the conveying direction.

In the second step of the exchange phase the can block is displaced by one can width in the direction toward the removal end and the full can now standing in front of the just can-less or empty spinning station is again brought to the spinning station transversely to the conveying direction, i.e. laterally in respect to the conveying track. The first exchange phase is ended with this.

A return movement of the can block by a can width follows, so that the gap just created on the conveying track by the full cans moving out is now located in front of the next spinning station. The empty can at this spinning station is conducted into the gap in the can block on the conveying track. Thereafter, the can block is again advanced by one can width in the removal direction and the next full can can be brought to the spinning station location which had previously become unoccupied. During the back and forth movement of the can block the exchange phase moves by respectively one step, namely essentially by one can width, sequentially through the entire can block from the removal side to the feed side of the conveying track.

It is clear that in method alternative A the can block can extend over the entire length of the conveying track and thus of the spinning machine. If at the section boundaries along the sequence of spinning stations the distance of one spinning station to the next spinning station is slightly larger than within a section, it is also possible to take this into consideration in connection with the back and forth movement of the can block, particularly when employing an automatic device with appropriate conveying means.

B. Block Exchange with Sliver Cans Spaced Apart Within the Conveying Track

The maximum storage capacity when the can exchange is ready to be made here is n/2 sliver cans. The full cans stored on the conveying track, which are to be exchanged for empty cans of a spinning machine side, are spaced apart in such a way, taking into consideration the measurements inside and at the boundaries of sections, if required, that at the first step of each exchange phase of the can exchange there already is an empty spot in the can block in front of every other empty can. In this way the empty cans can be brought simultaneously or one after the other, and in this case, too, either manually or with the aid of an automatic device, from the position at the spinning station into respectively one gap of the can block. The result of this first step is that now the entire can block consists of alternating full cans and empty cans.

In a second step of the exchange phase the can block (now fully occupied by full and empty cans) is displaced toward the removal end, so that a full can is in front of each spinning station which has just become empty. It again can be brought into the work position of the spinning station by lateral displacement. In the present connection an "empty" spinning station is also considered to be one that has several can spaces, and only one can needs to be exchanged in a particular case.

The empty cans remaining on the conveying track following a multi-exchange phase of the described second method alternative can be moved in a block (in the forward direction) out of the conveying track toward the removal end and replaced from the feed end by a fresh block of full cans, which are also spaced apart. This fresh can block can be used to provide the spinning stations which had remained "unprocessed" during the first multi-exchange phase in the same way as before, i.e. to also exchange the empty cans, which had remained there in the course of a one-time back and forth movement or reciprocation, for full cans.

There are many transitions between the described cases A and B. For example, in the course of the exchange in a can block in accordance with case A, individual block groups, for example section groups (=the length of a section), can be simultaneously exchanged. For example, it is possible in a first step to assign every i-th spinning station in the can block of the conveying track a can gap, so that simultaneously (in an exchange phase) respectively one can is to be exchanged at all i positions during the back and forth movement of the cans on the conveying track. The same as in the first case (A), instead of the can block moving on the conveying track, the exchange phase moves within the can block or within the described i sections of the block.

Unless individual empty cans are to be removed before, the can block stored on the conveying track can be moved as a whole out of the conveying track when all sliver cans have been exchanged and empty cans are needed in the can circulation. The storage or holding function is therefore not impaired by the can exchange. Conversely, the cans stored on the conveying track do not impair the exchange of individual cans. In case B, all cans can be stored and exchanged together.

The transport of the rectangular cans on the conveying track can take place in the conventional manner, for example by continuous, clocked, gravity or linear conveying means. It is also possible to employ displacement carts. Gravity conveyors are, for example, roller tracks. Linear conveyors are, for example, hooks, pins or the like set in the floor of the conveying track, which pull the individual cans or the can group along in the desired manner. Belt conveyors can of course also be used. Roller tracks are particularly advantageous if the exchange is to be performed manually. In all cases combinations of conveyors are also possible, since it is intended to make a conveyance in the long direction of the conveying track possible and, at each spinning station, a conveyance transversely in respect to the conveying track and back to the spinning station is to be made easier or possible. In this connection it should be taken into consideration that a filled rectangular can can have a weight on the order of magnitude of 40 kg, so that a transport by lifting cannot be a practical solution.

Details of the invention will be explained by means of the schematic representation of exemplary embodiments.

DETAILED DESCRIPTION OF THE PREFERRED EMBODIMENTS

Figure 1:
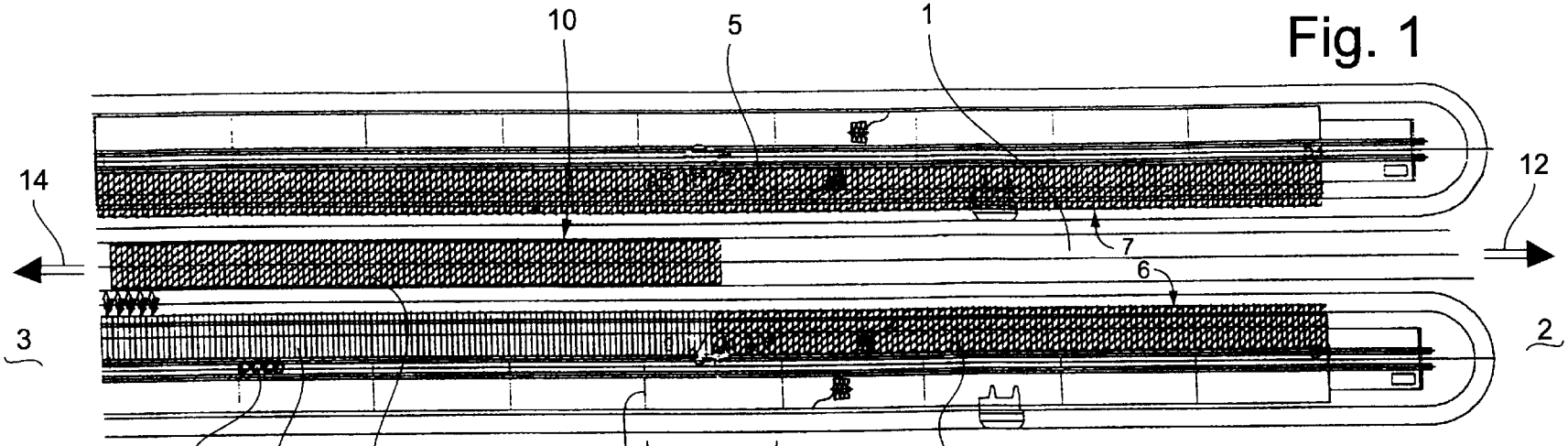
FIG. 1 is a schematic illustration of the system of the block exchange with cans fully loaded in a block on the conveying track according to a preferred embodiment of the present invention.
Figure 2:
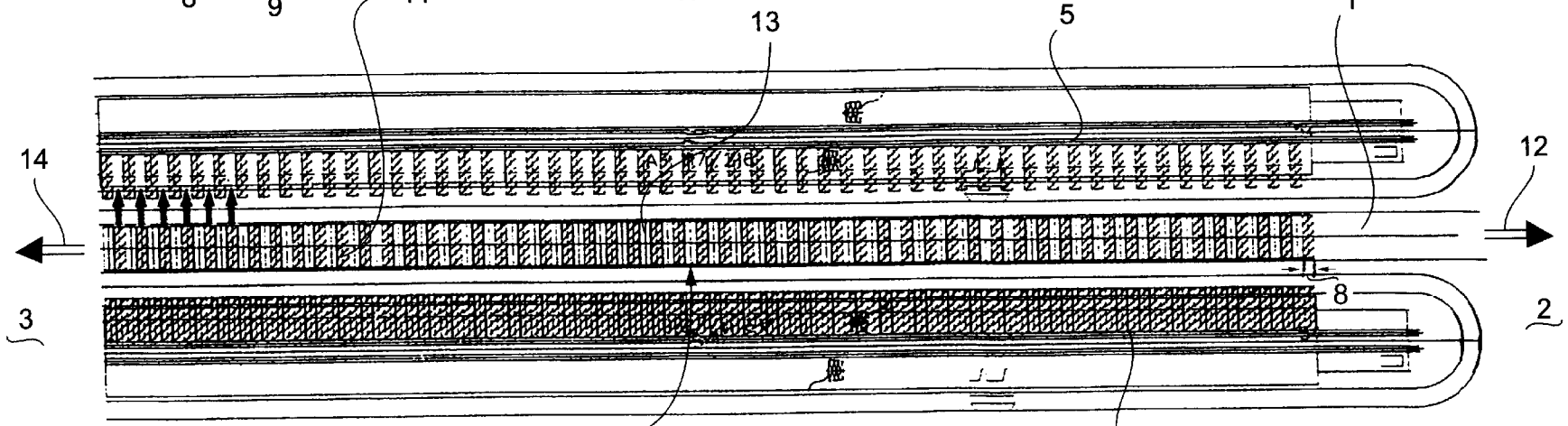
FIG. 2 is a schematic illustration of an alternate embodiment illustrating the system of the block exchange with cans spaced apart in a block on the conveying track.

In accordance with FIGS. 1 and 2 a conveying track 1, which extends from a feed end 2 to a removal end 3, is provided between spinning machines 4 and 5 (such as open end spinning machines). Along their two longitudinal sides 6 and 7, i.e., along the conveying track 1, each spinning machine can have a plurality of spindles or spinning stations 8, for example 108 to 144. A sliver can is associated with each spinning station, out of which a sliver which is to be processed is drawn during the spinning process. When this sliver can is emptied or is to be exchanged, although not completely empty, it is called an empty can 9.

In the exemplary embodiment of FIG. 1, a can block 10 of fully packed full sliver cans 11 is brought on the conveying track 1 from the direction of the feed end 2 and is stored there. In this case the conveying track is used, for example, as a holding or storage area in the can circulation of the spinning and drawing system.

When the sliver cans 9 of one longitudinal spinning side 6 or 7 of the conveying track 1 are emptied, it is possible in accordance with the method of the invention to use the sliver cans 11 held on the conveying track 1 for an exchange for the sliver cans which have become empty at the spinning stations 8, i.e. the empty cans 9.

It is assumed in FIG. 1 that prior to the start of the can exchange the front can of the can block 10 stands in front of the first spinning station in a series of spinning stations. The front is the removal end. With this prerequisite the can exchange starts by moving the entire can block 10 in a first step by one can width in the rearward direction 12, i.e., towards the feed end 2, in such a way that then the front empty can 9 is moved transversely in respect to the forward direction 14 into the empty space or gap created in the can block. In a second step, the can block 10 then is again displaced by a can width in the forward direction 14, i.e., toward the removal end 3, so that the first full can reaches the location at a spinning station which had been vacated in the previous step. The first exchange phase is completed with the lateral transfer of the full can to the empty location at the spinning station.

In the next exchange phase the gap left in the can block 10 is brought in front of the next spinning station by displacing the can block 10 in the rearward direction 12 by one can width. The empty can 9 present there is inserted into the can block 10 and the can block 10 is moved in the forward direction, so that the next full can can be supplied to the just vacated position in the second spinning station. In this manner, by moving the can block 10 back and forth stepwise, it is possible to replace the entire content of full cans 11 of the can block by empty cans 9, wherein a row of closely spaced spinning stations 8 can be provided with full sliver cans 11.

In the exemplary embodiment in FIG. 2 it is also possible to fill the entire conveying track 1 with a series of full sliver cans 11 in the form of a can block 10, initially for storage purposes. However, the cans can only be spaced apart in the block 15 at the latest during the exchange, i.e., can gaps 13 alternate with full cans. The same as in FIG. 1, the mutual distance between the sliver cans 11 in the block 15 is selected to be such that the distance variations at the boundaries 16 of sections 17 are taken into consideration, particularly in case of possible automation.

In accordance with the can exchange method indicated in FIG. 2 it is in principle possible in a manner similar to the one in accordance with FIG. 1, to exchange simultaneously following in a back-and-forth movement of the can block 15 with the gaps 13, every second empty can 9 of one longitudinal side 6 or 7 of the spinning machine 4 and 5, i.e., to supply only every other spinning station 8. Initially every second empty can 9 of, for example the longitudinal side 6, is brought on the conveying track 1 and from there into respectively one of the gaps 13 of the can block 15. Thereafter the entire can block 15 is displaced by one can width, so that a full can is placed in front of every vacated can location of a spinning station 8. The full cans are then fed transversely from the conveying track to the respective spinning stations. Following this one back and forth step in the alternate method in FIG. 2, the can block 15 only contains empty cans 9, which are initially spaced apart.

When these empty cans 9 are no longer to be stored and/or the can exchange should also be performed at the other alternate spinning stations, the empty can block 15 can be replaced by another block 15 of full cans, with the aid of which, also with the cans spaced with gaps 13, the remaining empty cans 9 of the spinning stations along the longitudinal side 6 of the spinning machine can be replaced by full cans 11.

A method for the exchange of full for empty rectangular spinning cans for a spinning machine having a plurality of spinning stations is described. With the method a conveying track is provided respectively between two rows of n spinning stations for the feeding of full sliver cans and the removal of empty sliver cans. In order to achieve that the conveying track can be simultaneously used as a holding area of a can circulation, as many as possible initially full sliver cans are stored on the conveying track and are exchanged in steps for empty cans at the spinning stations in the course of a back and forth movement in the conveying direction. In the course of the can exchange the exchange phase can move with a back-and-forth movement in the conveying direction of a can block present on the conveying track in one case along the closely packed can block from one can to the other or, in another case, when the cans are spaced apart beforehand on the conveying track, it can take place in the gap distance in one back-and-forth movement of the can block.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A method for the exchange of full rectangular sliver cans for empty sliver cans at a spinning machine having a plurality of spindles or spinning stations, wherein a conveying track for bringing in full sliver cans and for taking away empty sliver cans is disposed along a row of n spinning stations, comprising:

disposing a block of n/m full sliver cans in a row on said conveyor track along said row of spinning stations, wherein m=a whole number no less than 1;

forming gaps in said block for receiving a can in each of said gaps, wherein each of said gaps are aligned with an empty sliver can from at least one spinning station and wherein said gaps are formed alternating with said full sliver cans for alignment with said empty cans at alternate spinning stations;

simultaneously transferring said empty sliver cans to gaps from at least two spinning stations at which gaps are aligned;

moving said block to align full sliver cans from said block with each said at least two spinning stations from which said empty sliver cans had been transferred; and simultaneously transferring said full sliver cans from said block into each said at least two spinning stations from which said empty sliver can had been transferred.

2. The method according to claim 1, wherein the spinning stations are arranged in sections with spaces between sections and the steps of forming gaps and moving said block accommodates said spaces in aligning said gaps and said full cans of said block with the spinning stations.

* * * * *